US011228084B2

(12) United States Patent
Hayakawa et al.

(10) Patent No.: US 11,228,084 B2
(45) Date of Patent: Jan. 18, 2022

(54) ANTENNA MOUNTING APPARATUS

(71) Applicant: YOKOWO CO., LTD., Tokyo (JP)

(72) Inventors: Kenji Hayakawa, Gunma (JP); Masayuki Takano, Gunma (JP)

(73) Assignee: YOKOWO CO., LTD., Tokyo (JP)

( * ) Notice: Subject to any disclaimer, the term of this patent is extended or adjusted under 35 U.S.C. 154(b) by 148 days.

(21) Appl. No.: 16/527,065

(22) Filed: Jul. 31, 2019

(65) Prior Publication Data

US 2019/0356036 A1 Nov. 21, 2019

Related U.S. Application Data

(63) Continuation of application No. PCT/JP2018/003949, filed on Feb. 6, 2018.

(30) Foreign Application Priority Data

Feb. 10, 2017 (JP) ..... 2016-022862

(51) Int. Cl.

| | |
|---|---|
| ***H01Q 1/22*** | (2006.01) |
| ***H01Q 1/32*** | (2006.01) |
| *H01Q 1/12* | (2006.01) |
| *H01Q 9/04* | (2006.01) |

(52) U.S. Cl.

CPC ..... *H01Q 1/22* (2013.01); *H01Q 1/325* (2013.01); *H01Q 1/1221* (2013.01); *H01Q 9/0407* (2013.01)

(58) Field of Classification Search

CPC ..... H01Q 1/22; H01Q 1/325; H01Q 1/1221; H01Q 1/12; H01Q 1/3233; H01Q 1/3291

See application file for complete search history.

(56) References Cited

U.S. PATENT DOCUMENTS

| | | | | |
|---|---|---|---|---|
| 3,710,096 | A * | 1/1973 | McFarlin | F21V 21/04 248/27.1 |
| 7,746,281 | B2 * | 6/2010 | Yamada | H01Q 1/1207 343/713 |
| 8,011,628 | B1 * | 9/2011 | Suddeth | H01Q 1/12 248/225.11 |
| 8,780,008 | B2 * | 7/2014 | Lettkeman | H01Q 1/12 343/878 |
| 2008/0100528 | A1 * | 5/2008 | Noro | H01Q 9/0407 343/872 |

(Continued)

FOREIGN PATENT DOCUMENTS

| | | |
|---|---|---|
| CN | 105917520 A | 8/2016 |
| JP | 1985-185797 U | 12/1985 |

(Continued)

OTHER PUBLICATIONS

Chinese Office Action dated Sep. 3, 2020, issued in corresponding Chinese Patent Application No. 201880007891.X.

(Continued)

*Primary Examiner* — Tan Le
(74) *Attorney, Agent, or Firm* — Xsensus LLP

(57) ABSTRACT

An antenna mounting apparatus, including a bracket that holds at least a part of electronic components constituting an antenna device including an antenna element, the bracket being fixed by a bolt fixed to a frame; and a holder provided on a first surface of the bracket facing the frame, the holder temporarily fixing the bolt.

6 Claims, 15 Drawing Sheets

(56) References Cited

U.S. PATENT DOCUMENTS

2010/0302127 A1* 12/2010 Frank ..... H01Q 1/007
343/892
2017/0237156 A1* 8/2017 Taira ..... H01Q 1/1214
343/713

FOREIGN PATENT DOCUMENTS

| | | | |
|---|---|---|---|
| JP | 1986-59984 | U | 4/1986 |
| JP | 2002-48117 | A | 2/2002 |
| JP | 2008-42373 | A | 2/2008 |
| JP | 2012-151691 | A | 8/2012 |
| JP | 2013-162542 | A | 8/2013 |

OTHER PUBLICATIONS

Extended European Search Report dated Oct. 22, 2020, issued in corresponding European Patent Application No. 18751333.8.
International Search Report and Written Opinion dated Apr. 10, 2018 for PCT/JP2018/003949 filed on Feb. 6, 2018, 9 pages including English Translation of the International Search Report.

* cited by examiner

ANTENNA MOUNTING APPARATUS

CROSS-REFERENCE TO RELATED APPLICATION

This application is a continuation of International Application No. PCT/JP2018/003949, filed Feb. 6, 2018, which claims priority from Japanese Patent Application No. 2017-022862, filed on Feb. 10, 2017, the contents of which are incorporated herein by reference.

TECHNICAL FIELD

The present disclosure relates to an antenna mounting apparatus.

BACKGROUND

Conventionally, as in Patent Literature 1, there has been proposed an antenna mounting apparatus capable of temporarily fixing an antenna device to a frame to which a bolt is fixed by using a temporary fixing tool such as a temporary fixing clip.

CITATION LIST

Patent Literature

Patent Literature 1: JP 2008-42373 A

SUMMARY

The present disclosure provides an antenna mounting apparatus, comprising: a bracket that holds at least a part of electronic components constituting an antenna device including an antenna element, the bracket being fixed by a bolt fixed to a frame; and a holder provided on a first surface of the bracket facing the frame, the holder temporarily fixing the bolt.

DETAILED DESCRIPTION

Technical Problem

Figure 1:
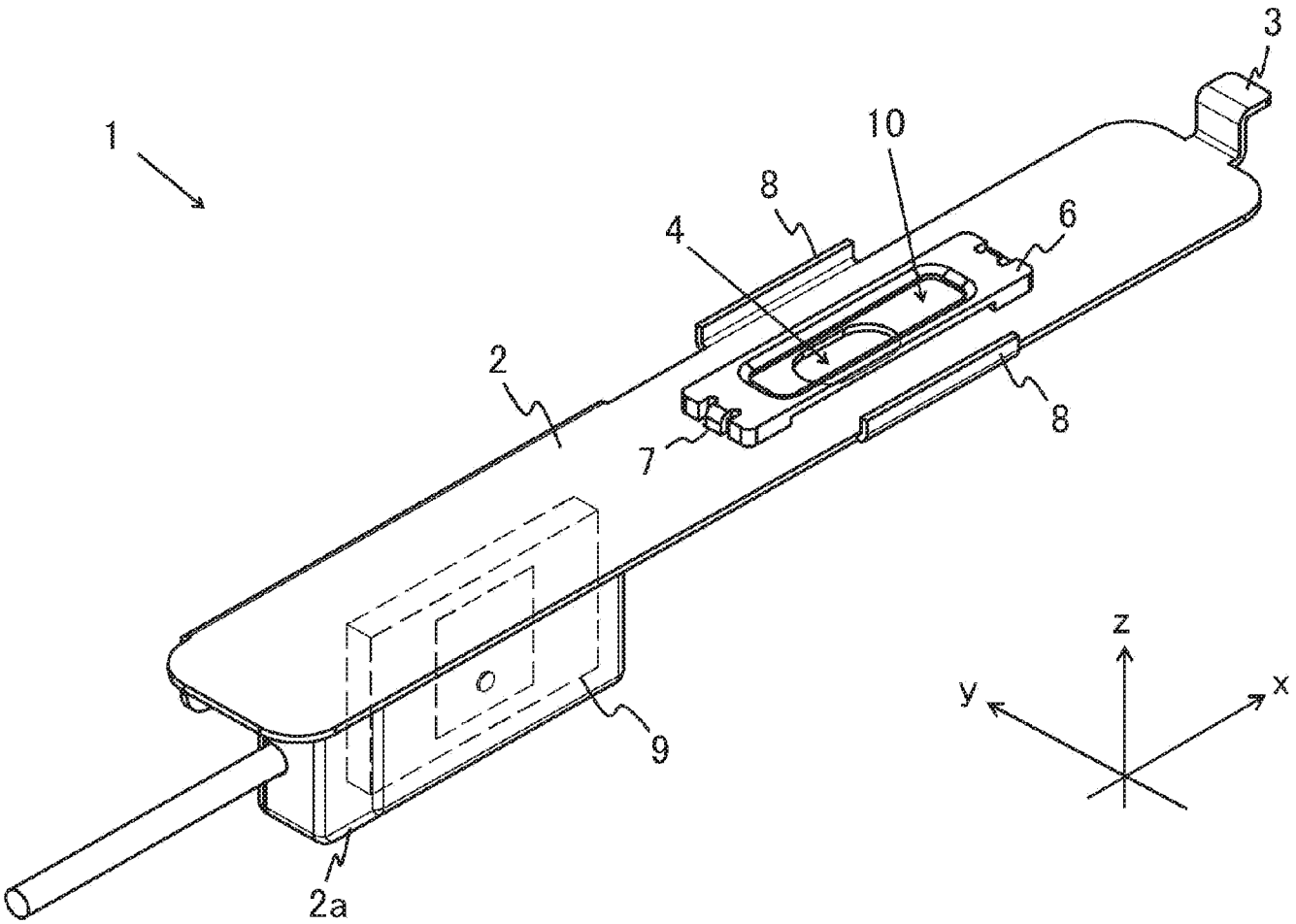
FIG. 1 is a perspective view of an antenna mounting apparatus according to the present embodiment as viewed from above.

It is necessary to separately provide a hole for holding a temporary fixing clip (temporary fixing tool) on a frame side. Furthermore, it is necessary to be careful not to damage the temporary fixing tool at the time of attachment or removal.

Therefore, an object of the present disclosure is to provide an antenna mounting apparatus having a low possibility that a temporary fixing tool such as a clip is damaged without separately providing a hole for holding a temporary fixing clip on a frame side.

Solution to Problem

An antenna mounting apparatus according to the present disclosure includes a bracket that holds at least a part of electronic components constituting an antenna device including an antenna element and is fixed by a bolt fixed to a frame and a holder that is provided on a first surface of the bracket facing the frame and temporarily fixes the bolt.

The holder attached to the bracket is temporarily fixed to the bolt, whereby the bracket is temporarily fixed to the frame. Therefore, it is possible to easily perform temporary fixing without providing a hole for a temporary fixing clip or the like in the frame.

The holder is not in contact with a nut since the holder is provided on the first surface of the bracket facing the frame, that is, an opposite side to a surface of the bracket in contact with the nut attached to the bolt.

For this reason, it is possible to decrease a possibility that the holder is damaged when the bolt is tightened with the nut, as compared with an embodiment in which a holder is provided on a surface on an opposite side to a first surface of a bracket.

The antenna element can be held at a low position by a thickness of the holder. Therefore, in a case where the antenna element such as a patch antenna is mounted on the antenna mounting apparatus, and the antenna mounting apparatus is attached to a ceiling frame of a windshield (or rear glass) of a vehicle, it becomes easy to avoid physical interference with a metal shield around the antenna element (especially in an upward direction).

It is preferable that the bracket is provided with a protective member that protects the holder, and a length of the protective member projecting from the first surface to a side on which the frame is located is longer than a length between a surface of the holder facing the frame and the first surface.

The holder is positioned between the bracket and the frame in a state in which the holder is not in contact with the frame (the protective member protects the holder), whereby it is possible to further decrease a possibility that the holder is damaged when the bolt is tightened with a nut, as compared with an embodiment in which the protective member is not provided.

The antenna element can be held at a low position by a thickness of the protective member. Therefore, in a case where the antenna element such as a patch antenna is mounted on the antenna mounting apparatus, and the antenna mounting apparatus is attached to the ceiling frame of the windshield (or rear glass) of the vehicle, it becomes easy to avoid physical interference with the metal shield around the antenna element (especially in the upward direction).

Furthermore, it is preferable that at least a region in the holder in contact with the bolt is made of resin or rubber.

In a case where at least a region in the holder in contact with the bolt is made of resin, rubber or the like, the bolt can be easily removed and is not easily damaged, as compared with a case where the region is made of metal.

Furthermore, it is preferable that at least one of the bracket and the holder is provided with a spacer that maintains a state in which at least the region in the holder in contact with the bolt is separated from the frame.

Furthermore, it is preferable that the bracket is provided with a bolt hole through which the bolt passes, and when viewed from a vertical direction in which the bracket and the holder are arranged, a dimension of a region in the bolt hole not overlapping a member constituting the holder in one direction perpendicular to the vertical direction is equal to or shorter than a nominal diameter of the bolt.

Furthermore, it is preferable that the bracket is provided with the bolt hole through which the bolt passes, the holder is provided with a beam, a gap is provided between the beam and the bracket, and when viewed from the vertical direction in which the bracket and the holder are arranged, a dimension of a region in the bolt hole not overlapping the beam in one direction perpendicular to the vertical direction is equal to or shorter than the nominal diameter of the bolt.

As described above, according to the present disclosure, it is possible to provide the antenna mounting apparatus having a low possibility that the temporary fixing tool such as the clip is damaged without separately providing a hole for holding the temporary fixing clip on the frame side.

Hereinafter, the present embodiment will be described with reference to FIGS. 1 to 11. For example, as illustrated in FIG. 8, an antenna mounting apparatus 1 according to the present embodiment is used to attach an antenna device such as a patch antenna 9 to a lower surface of a ceiling frame 11 of a vehicle that is a region where a fixing bolt 12 and a claw hole 13 are provided.

Note that in order to describe directions, a longitudinal direction of the antenna mounting apparatus 1 (left and right direction, direction in which a hole for attaching the fixing bolt 12 of the ceiling frame 11 and the claw hole 13 are arranged) will be described as an x direction, a horizontal direction perpendicular to the x direction (front and rear direction) will be described as a y direction, and a vertical direction perpendicular to the x direction and the y direction will be described as a z direction.

The antenna mounting apparatus 1 includes, for example, a bracket 2 and a holder (temporary fixing tool) 6, as illustrated in FIG. 1.

Figure 2:
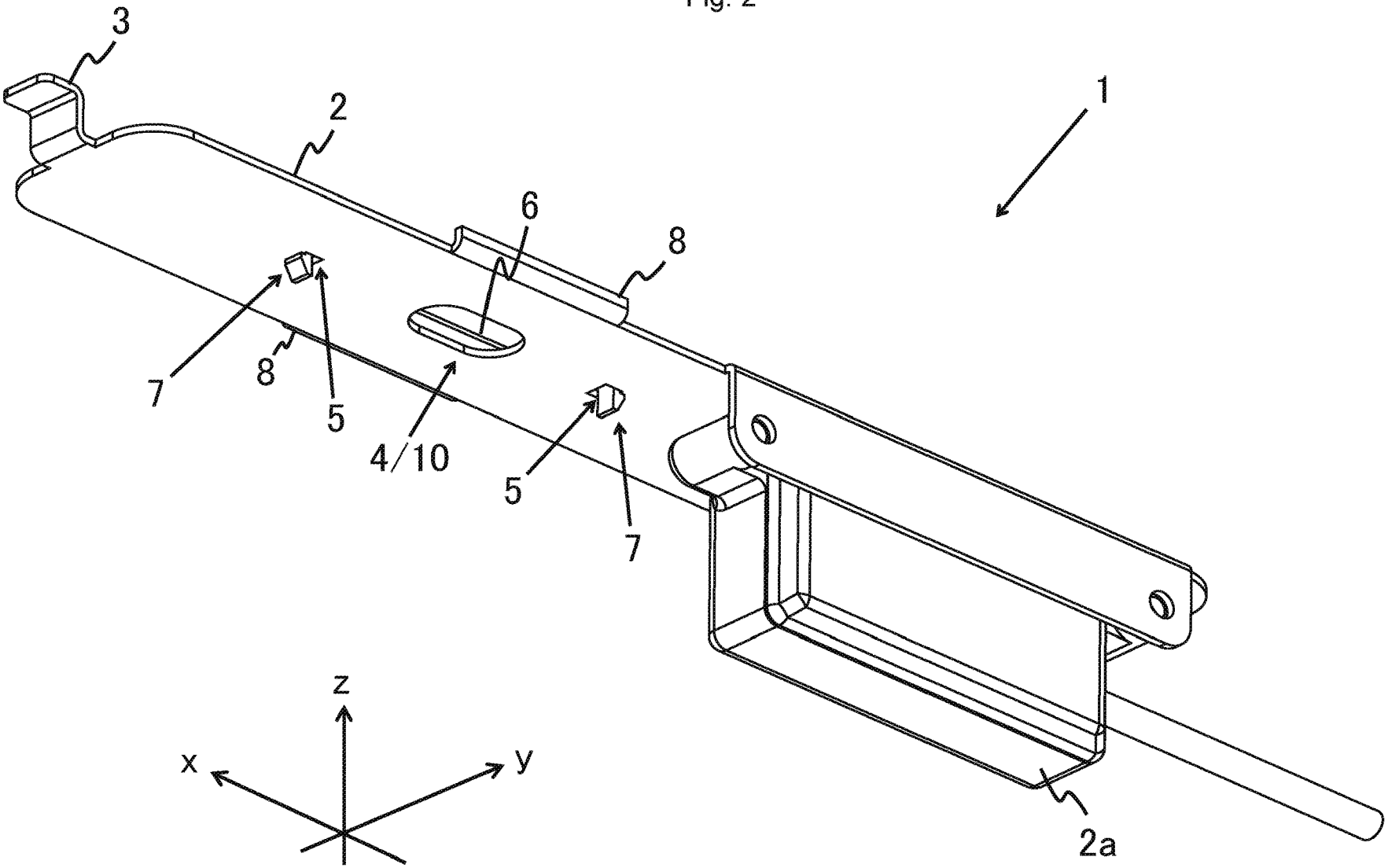
FIG. 2 is a perspective view of the antenna mounting apparatus as viewed from below.

The bracket 2 holds at least a part of electronic components constituting the antenna device including an antenna element such as the patch antenna 9 and is fixed to the ceiling frame 11 by the bolt 12 which is fixed on the ceiling frame 11. For example, as illustrated in FIG. 2, the bracket 2 is a metal plate of substantially rectangular shape extending in the x direction, and includes an antenna case 2*a*, a claw 3, a fixing bolt hole 4, a hook hole 5, and a wall (protective member) 8.

However, the shape of the metal plate constituting the bracket 2 is not limited to the substantially rectangular shape and may be another shape.

Furthermore, positional relationship between the antenna case 2*a*, the claw 3, and the fixing bolt hole 4 in the bracket 2 is not limited to the following example.

Figure 3:
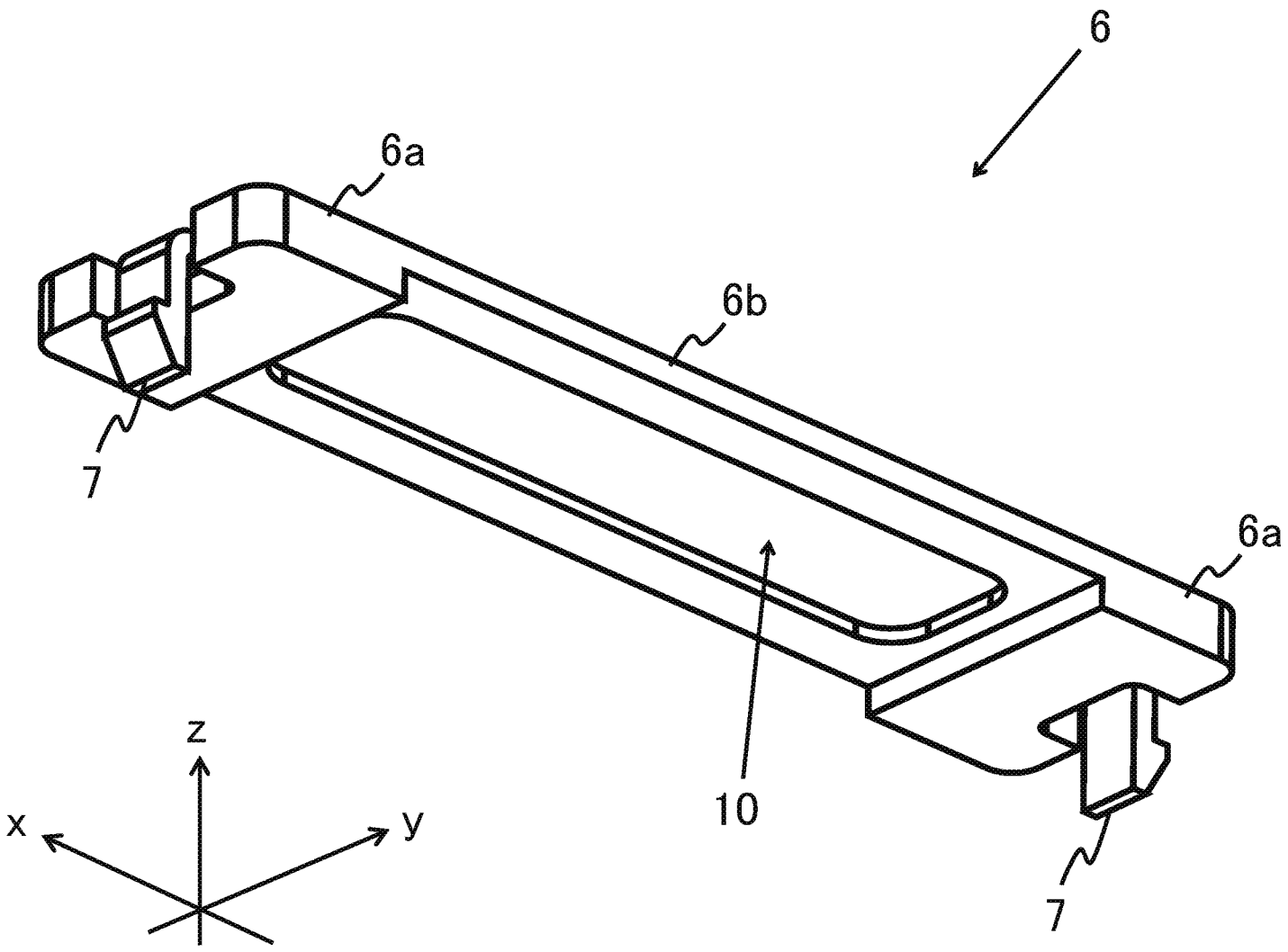
FIG. 3 is a perspective view of a holder as viewed from below.

The holder 6 is provided on a first surface in the bracket 2 facing the ceiling frame 11 and temporarily fixes the bolt 12. For example, as illustrated in FIG. 1, the holder 6 is provided on an upper surface (first surface facing the ceiling frame 11) of the bracket 2 and in the vicinity of the fixing bolt hole 4 so that at least a part of the holder 6 overlaps the fixing bolt hole 4 when viewed from the z direction. For example, as illustrated in FIG. 3, the holder 6 includes an end 6*a*, a beam 6*b*, and a hook 7.

Figure 9:
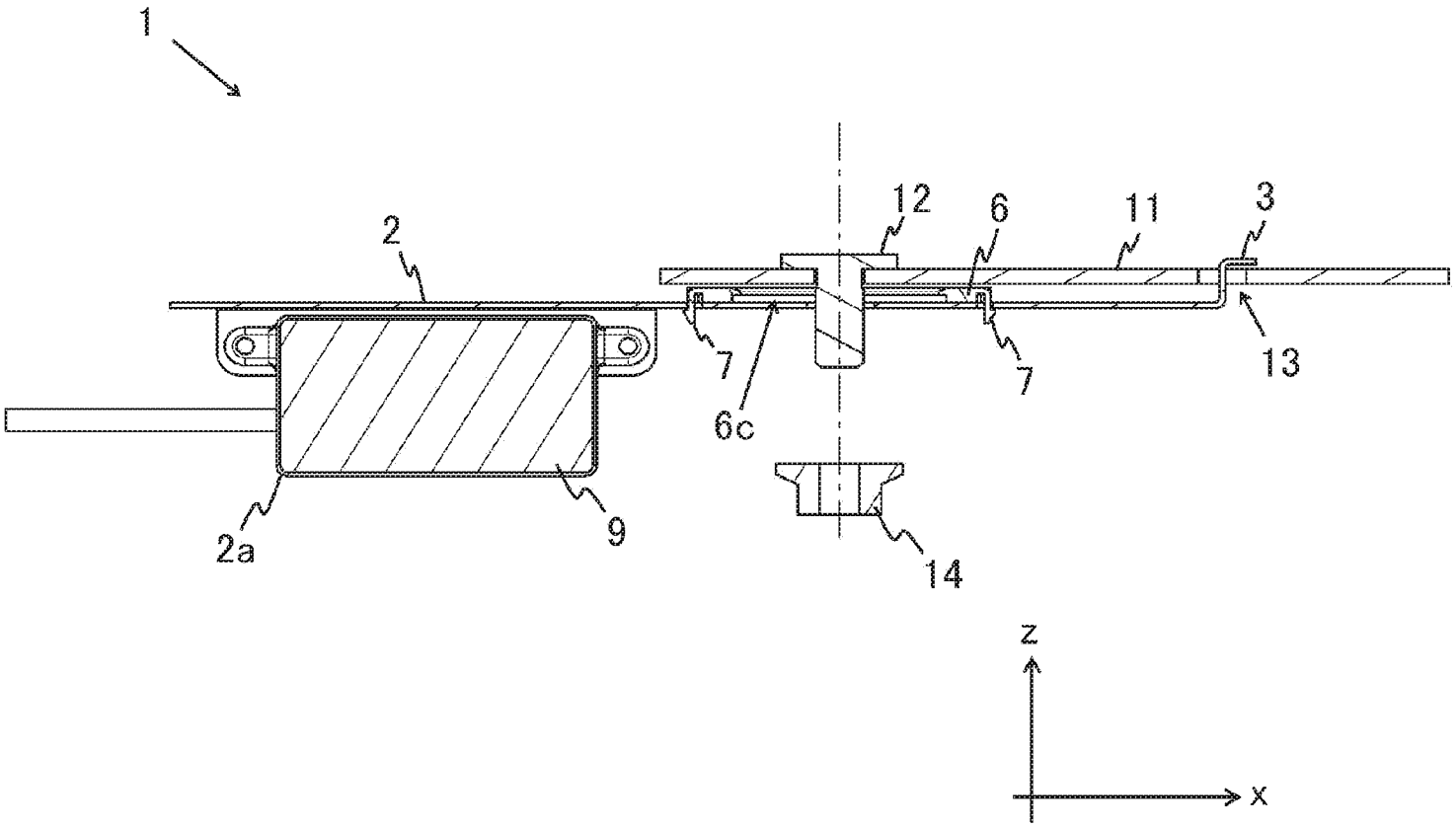
FIG. 9 is a view illustrating the antenna mounting apparatus temporarily fixed to the ceiling frame in A-A cross section of FIG. 4.

As illustrated in FIG. 9, the holder 6 is engaged with a screw thread of the fixing bolt 12 and is used to temporarily fix the fixing bolt 12 by the engagement. The holder 6 may be made of, for example, metal, but is desirably made of resin or rubber.

Furthermore, at least a portion of the holder 6 in the vicinity of an internal space 10 (region in the holder 6 in contact with the fixing bolt 12) to be described later may be made of resin or rubber, and the other portion of the holder 6 may be made of metal other than resin or rubber.

As illustrated in FIG. 1, a specific configuration of the bracket 2 will be described.

The antenna case 2*a* is provided on a lower surface of one end of the bracket 2 in the x direction, and the patch antenna 9 is held inside the antenna case 2*a*.

In the present embodiment, description will be given on the assumption that the patch antenna 9 held by the antenna case 2*a* includes not only the antenna element for receiving signals from other vehicles or satellites, but also electronic components constituting the antenna device such as an amplifier for amplifying the signals obtained by the antenna element and a substrate on which the antenna element and the amplifier are implemented. However, a part of the electronic components constituting the antenna device may be held by the antenna case 2*a*, and the rest of the electronic components may be held by another member other than the bracket 2.

Furthermore, instead of the patch antenna 9, an antenna element or the like of another linear antenna may be held by the antenna case 2*a*.

The claw 3 of a substantially L shape when viewed from the y direction is provided on an upper surface of the other end of the bracket 2 in the x direction.

The claw 3 is integrally formed with the bracket 2 but may be removable.

The fixing bolt hole 4 is provided between a region in the bracket 2 where the antenna case 2*a* is provided and a region in the bracket 2 where the claw 3 is provided. The fixing bolt 12 is inserted into the fixing bolt hole 4. The fixing bolt 12 is attached to the ceiling frame 11 with projecting downward in the z direction.

Figure 5:
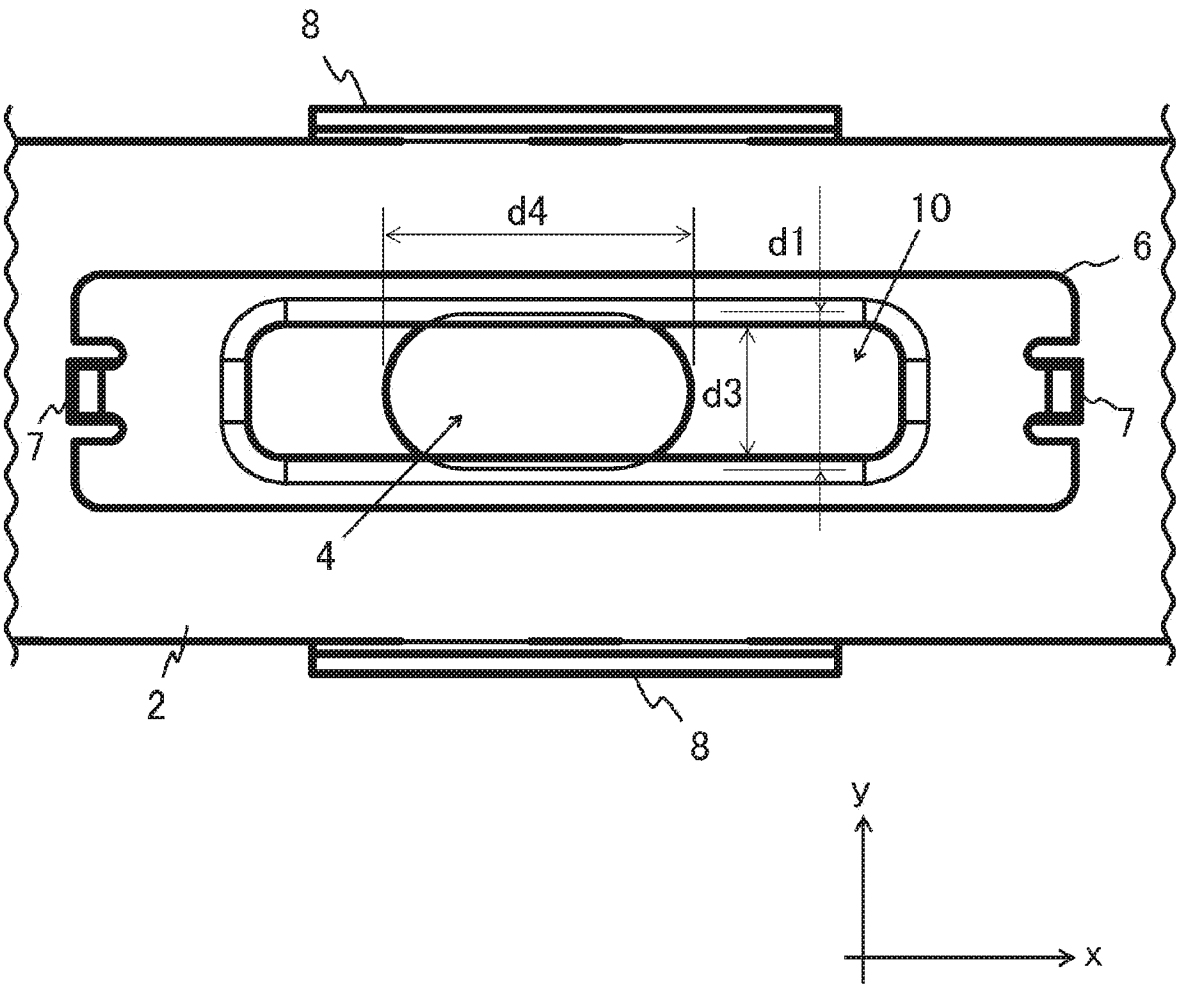
FIG. 5 is an enlarged top view of a region where the holder in FIG. 4 is located.
Figure 11:
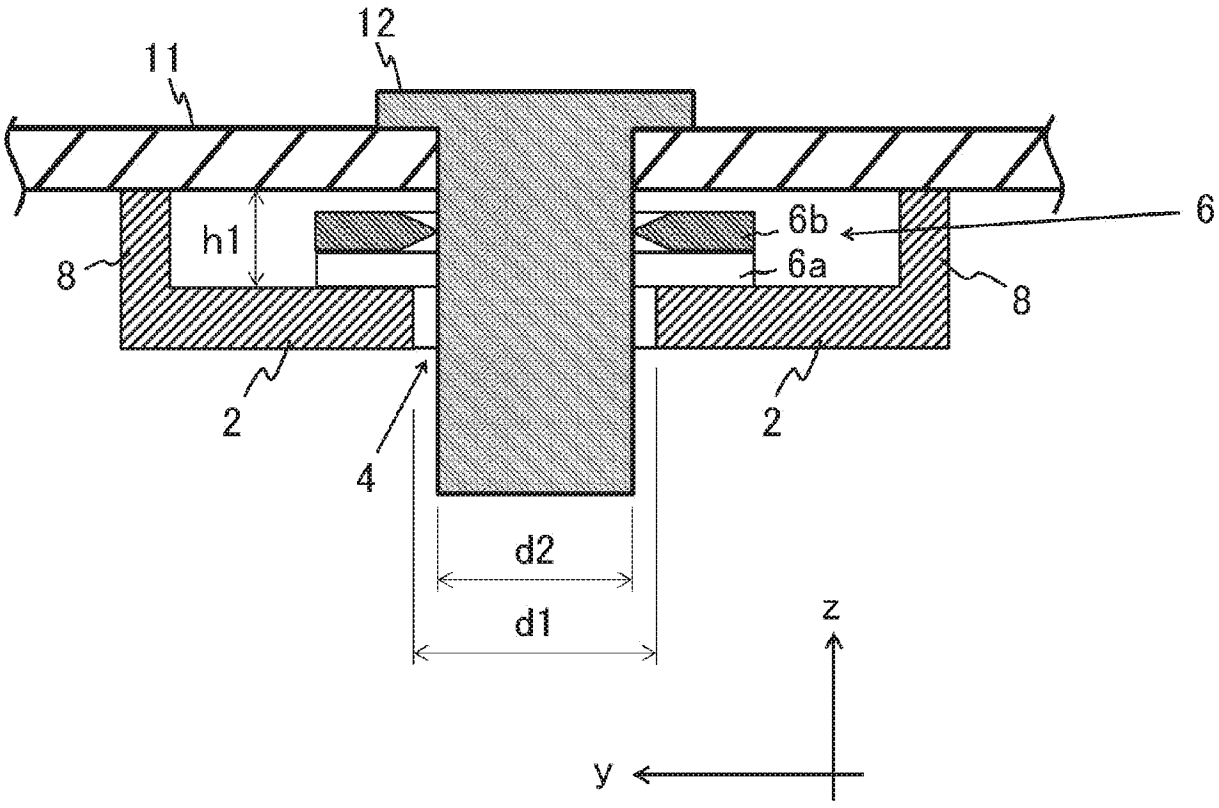
FIG. 11 is a view illustrating the antenna mounting apparatus temporarily fixed to the ceiling frame in B-B cross section of FIG. 4.

As illustrated in FIG. 11, a y-directional dimension d1 of the fixing bolt hole 4 is longer than a nominal diameter d2 of the fixing bolt 12 (basic dimension of external diameter of a male screw). Furthermore, as illustrated in FIG. 5, an x-directional dimension d4 of the fixing bolt hole 4 is longer than the y-directional dimension d1 of the fixing bolt hole 4.

However, the x-directional dimension d4 of the fixing bolt hole 4 may be any length as long as the x-directional dimension d4 is longer than a nominal diameter d2 of the fixing bolt 12 and may be shorter than the y-directional dimension d1 of the fixing bolt hole 4.

As illustrated in FIG. 2, the hook holes 5 through which the hooks 7 provided on the holder 6 pass are provided at both x-directional ends of the region in the bracket 2 where the fixing bolt hole 4 is provided.

Figure 4:
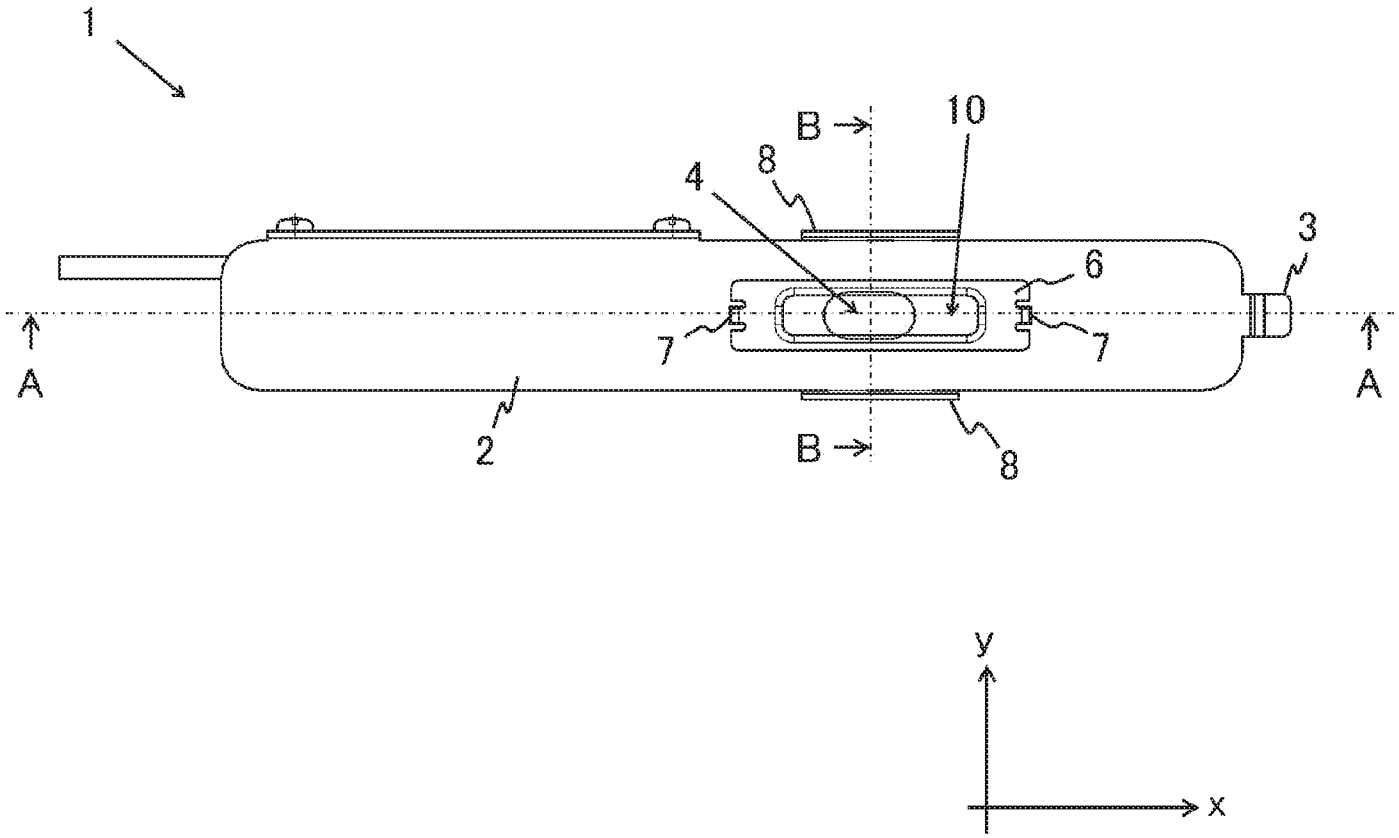
FIG. 4 is a top view of the antenna mounting apparatus.

As illustrated in FIGS. 1 and 4, the walls 8 projecting upward in the z direction are provided at both y-directional ends of the region in the bracket 2 where the fixing bolt hole 4 is provided.

Figure 10:
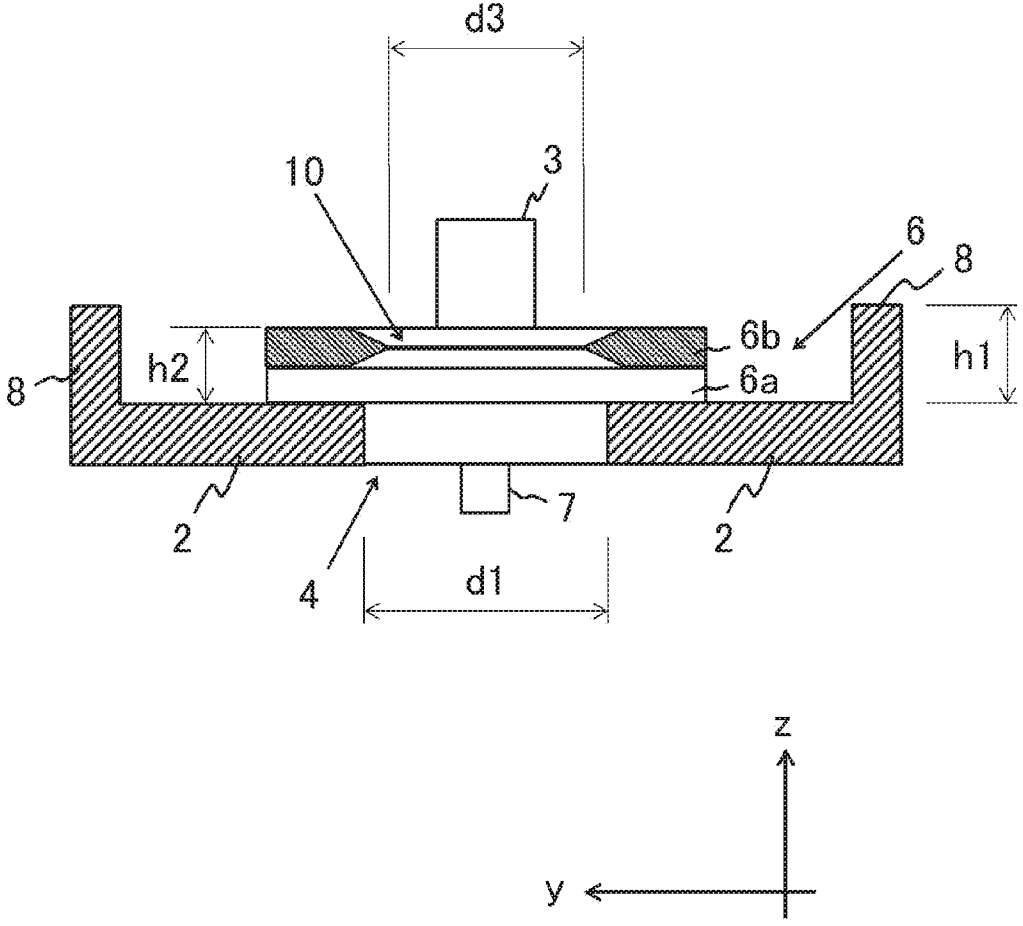
FIG. 10 is a cross-sectional view taken along line B-B in FIG. 4.

As illustrated in FIG. 10, the wall 8 is integrally formed with the bracket 2. The wall 8 is used as a spacer that maintains a state in which when the bracket 2 is screwed to the ceiling frame 11, the upper surface of the bracket 2 and the ceiling frame 11 separate from each other by a fixed distance (first height h1 to be described later) and the region in the holder 6 in contact with the fixing bolt 12 separates from the ceiling frame 11.

A length (first height h1) of the wall 8 projecting from the upper surface of the bracket 2 to a side on which the ceiling frame 11 is located (upward in the z direction) is longer than a length between the surface of the holder 6 facing the ceiling frame 11 and the upper surface of the bracket 2 (height of the end 6*a* (second height h2)) (h1>h2).

The protective member such as the wall 8 is not limited to being provided at the end of the bracket 2 in the y direction. For example, there may be provided a plurality of projections or walls projecting by the first height h1 from the upper surface of the bracket 2 to the side on which the ceiling frame 11 is located.

Furthermore, the wall 8 may be removable from the bracket 2.

Positional relationship and dimensions of the fixing bolt hole 4 and the like in the bracket 2 are determined so that an x-directional distance between the claw 3 and the center of the fixing bolt hole 4 is substantially equal to an x-directional distance between the center of the fixing bolt 12 attached to the ceiling frame 11 and the claw hole 13 provided in the ceiling frame 11.

Next, a specific configuration of the holder 6 will be described.

As illustrated in FIG. 3, the holder 6 has the ends 6*a* that are thick at both x-directional ends and two beams 6*b* that are thinner than the end 6*a*, the two beams 6*b* being located between the ends 6*a* and at the top.

Each of the two beams 6*b* constitutes a both ends-fixed beam held by two ends 6*a*.

The internal space 10 is formed in a region surrounded by the ends 6*a* and the beams 6*b* when viewed from the z direction.

The holder 6 has a substantially hollow rectangular shape (having a substantially rectangular outer shape and a shape in which the internal space 10 of a substantially rectangular shape including an elongated hole shape or an oval shape is provided at the center) when viewed from above, and the holder 6 has a shape obtained by turning a substantially recessed shape upside down when viewed from the y direction.

Figure 6:
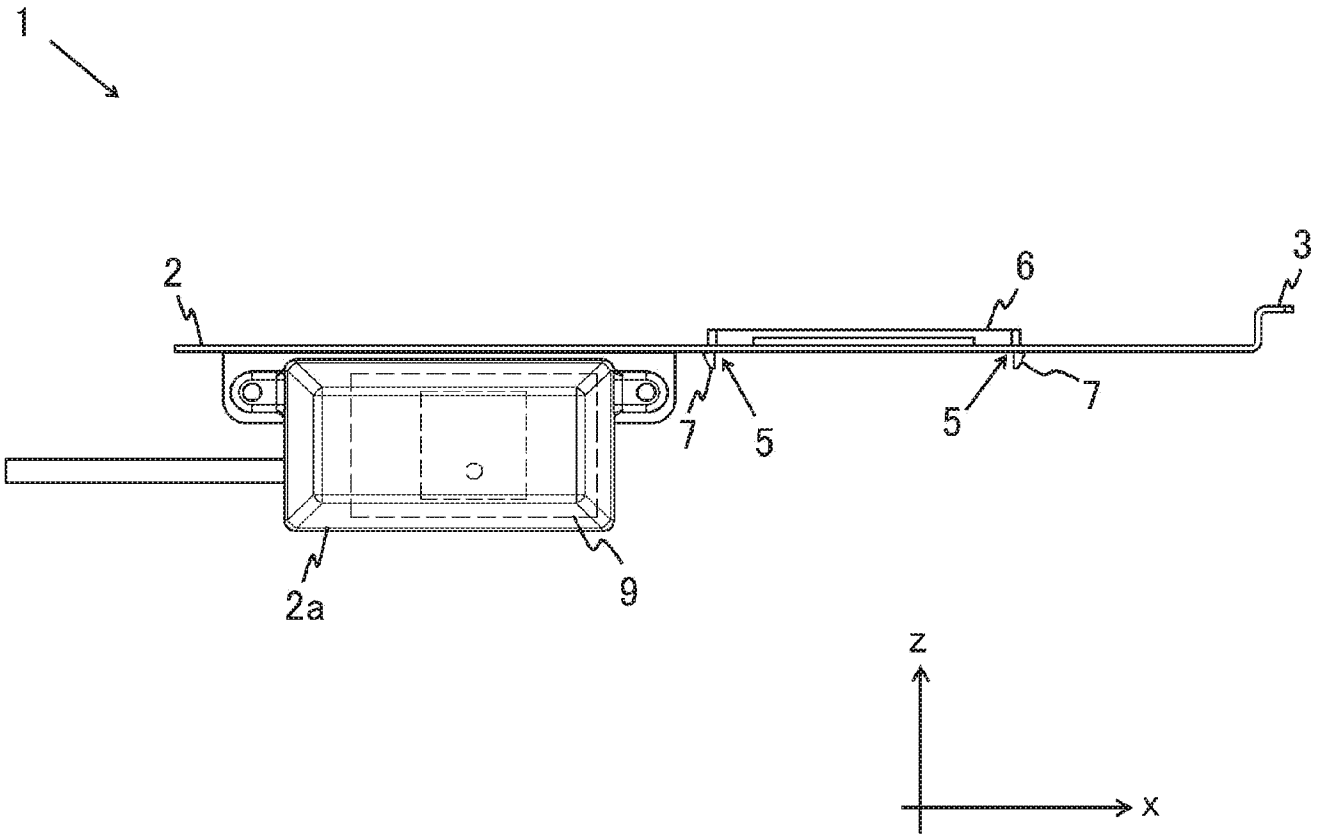
FIG. 6 is a side view of the antenna mounting apparatus, not illustrating a wall (protective member).

The end 6*a* is provided with the hook 7 extending downward in the z direction. As illustrated in FIG. 6, the hook 7 is inserted into and latched to the hook hole 5 of the bracket 2 from above, whereby the holder 6 is attached to the upper surface of the bracket 2.

Figure 7:
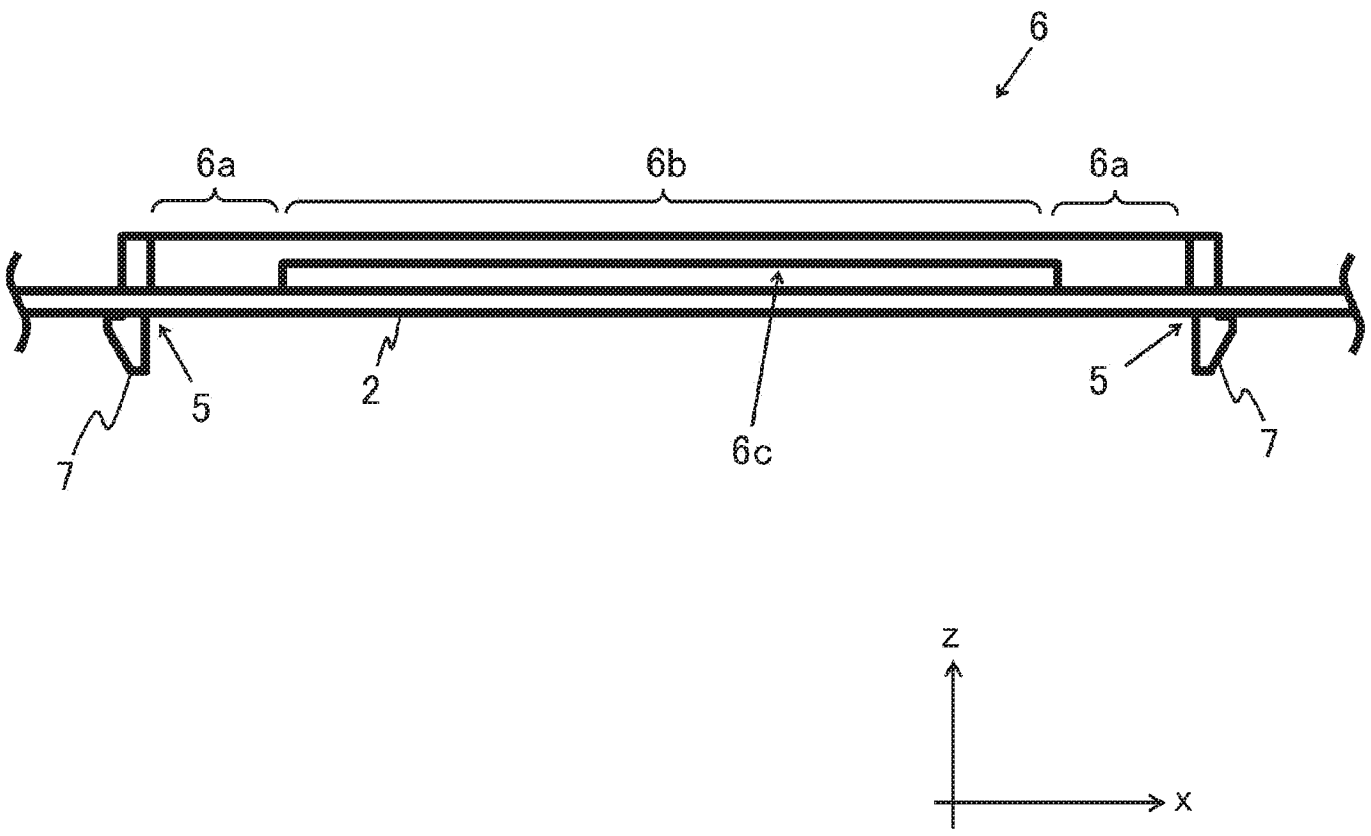
FIG. 7 is an enlarged side view of a region where the holder in FIG. 6 is located.
Figure 8:
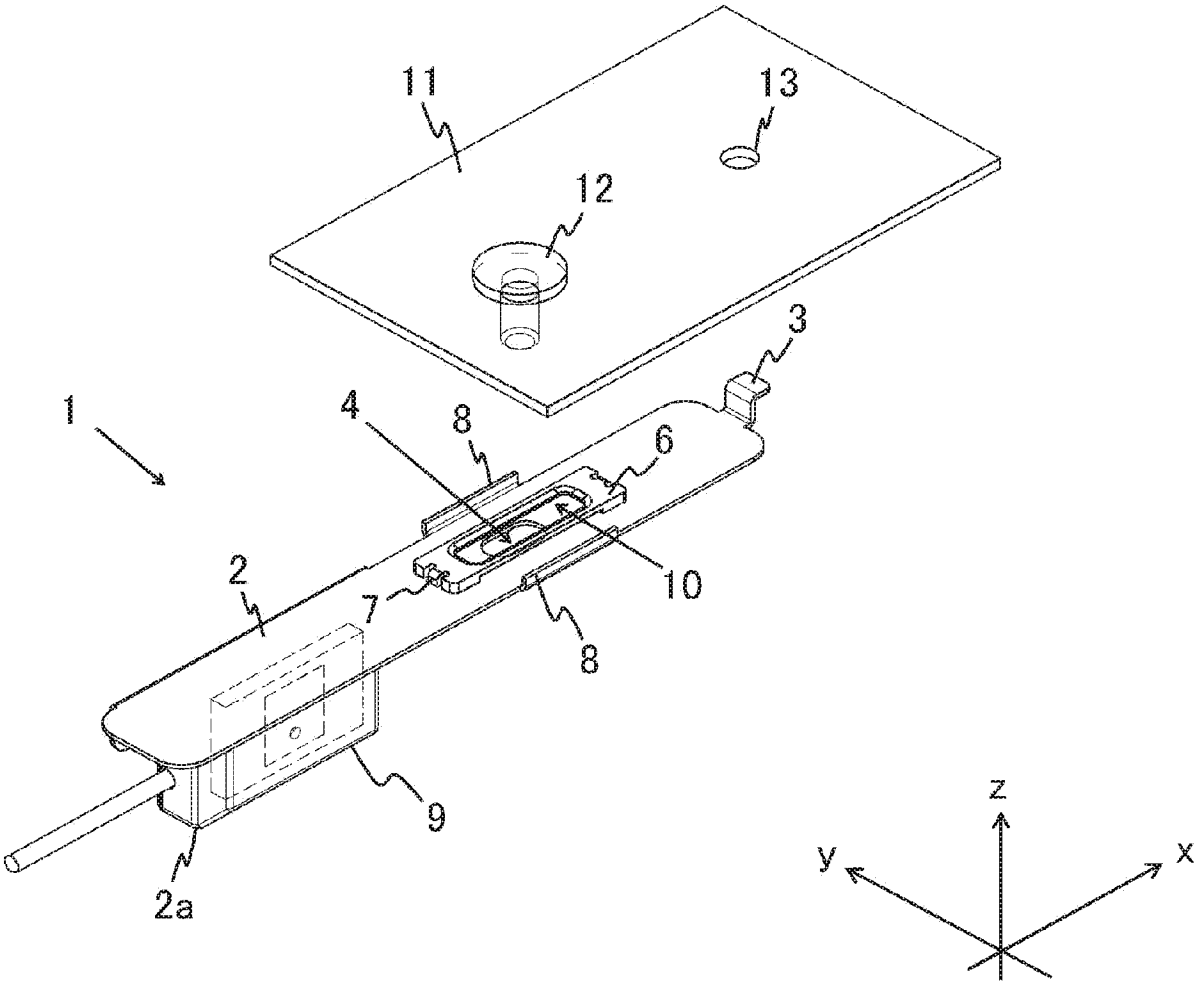
FIG. 8 is a perspective view of the antenna mounting apparatus before being temporarily fixed to a ceiling frame.

As illustrated in FIG. 7, when the holder 6 is attached to the bracket 2, the end 6*a* is in contact with the upper surface of the bracket 2, and a gap 6*c* is formed between the beam 6*b* and the upper surface of the bracket 2.

As illustrated in FIGS. 10 and 11, a dimension of each part of the holder 6 and positional relationship between the holder 6 and the bracket 2 are determined so that a y-directional dimension d3 of the region overlapping the internal space 10 in the fixing bolt hole 4 when viewed from the z direction (y-directional interval between the two beams 6*b*) is shorter than the y-directional dimension d1 of the fixing bolt hole 4 and is substantially equal to or shorter than the nominal diameter d2 of the fixing bolt 12 (d3≤d2<d1).

Furthermore, each beam 6*b* is in positional relationship in which a part thereof overlaps the fixing bolt hole 4 when viewed from the z direction.

A region in one end 6*a* in which the beam 6*b* is not attached and that is on a side facing the other end 6*a* may have a tapered shape having a thickness equal to or less than an interval between the screw threads of the fixing bolt 12 and having a sharp pointed tip. Furthermore, a region in the other end 6*a* in which the beam 6*b* is not attached and that is on a side facing one end 6*a* may have a tapered shape having a thickness equal to or less than the interval between the screw threads of the fixing bolt 12 and having a sharp pointed tip (see FIG. 9).

It is desirable that a side in the one beam 6*b* facing the other beam 6*b* has a tapered shape having a thickness equal to or less than the interval between the screw threads of the fixing bolt 12 and having a pointed tip. Furthermore, it is desirable that a side in the other beam 6*b* facing one beam 6*b* has a tapered shape having a thickness equal to or less than the interval between the screw threads of the fixing bolt 12 and having a pointed tip (see FIG. 10).

In the present embodiment, an embodiment in which the holder 6 is attached to the bracket 2 by using the hook hole 5 and the hook 7 is illustrated. However, a holder 6 may be attached to the bracket 2 by screwing via a washer.

In this case, by changing a thickness of the washer, an interval between the beam 6*b* and the upper surface of the bracket 2 (dimension of the gap 6*c*) can be adjusted. Thus, the positional relationship between the holder 6 and the bracket 2 can be adjusted while corresponding to the temporary fixing of the fixing bolt 12 of various shapes.

Next, a procedure for attaching the antenna mounting apparatus 1 to the ceiling frame 11 will be described.

In advance, the patch antenna 9 is attached to the antenna case 2*a* in the antenna mounting apparatus 1, and the holder 6 is attached to the upper surface of the bracket 2.

For example, as illustrated in FIG. 9, a worker inserts the claw 3 into the claw hole 13 of the ceiling frame 11 and latches the claw 3 to the claw hole 13. Then, the worker brings the upper surface of the bracket 2 close to a lower surface of the ceiling frame 11 with the claw 3 latched to the claw hole 13 and inserts the fixing bolt 12 attached to the ceiling frame 11 into the hole (internal space 10) of the holder 6 and the fixing bolt hole 4. In the present embodiment, for example, as illustrated in FIGS. 10 and 11, a y-directional dimension d3 of the hole (internal space 10) of the holder 6 is substantially equal to or shorter than the nominal diameter d2 of the fixing bolt 12. That is, the y-directional interval between the two beams 6*b* of the holder 6 is substantially equal to or shorter than the nominal diameter d2 of the fixing bolt 12. However, since at least the two beams 6*b* can be elastically deformed (bent), the fixing bolt 12 is inserted into the hole (internal space 10) of the holder 6 while the two beams 6*b* of the holder 6 are elastically deformed (bent) in a direction away from each other.

Since the beams 6*b* of the holder 6 are in contact with the fixing bolt 12 in a state of being elastically deformed, and the holder 6 holds (temporarily fixes) the fixing bolt 12, the bracket 2 does not fall from the ceiling frame 11 even if the worker releases his or her hand. Furthermore, since a tapered portion having a sharp pointed tip in the beam 6*b* that forms a part of an outer shape of the internal space 10 enters between the screw threads of the fixing bolt 12, the holder 6 can securely hold the fixing bolt 12.

Thereafter, the worker screws a nut 14 into a portion in the fixing bolt 12 projecting from a lower surface of the bracket 2, and the attachment of the antenna mounting apparatus 1 to the ceiling frame 11 is completed.

The holder 6 attached to the bracket 2 is temporarily fixed to (engaged with) the fixing bolt 12, whereby the bracket 2 is temporarily fixed to the ceiling frame 11. Thus, for example, the worker can easily perform temporary fixing without providing a hole for a temporary fixing clip or the like in the ceiling frame 11.

Furthermore, the holder 6 is provided on the upper surface of the bracket 2 (first surface facing the ceiling frame 11). That is, since the holder 6 is provided on the side opposite to a lower surface in the bracket 2 in contact with the nut 14, the holder 6 is not in contact with the nut 14.

Therefore, it is possible to decrease a possibility that the holder 6 is damaged when the fixing bolt 12 is tightened with the nut 14, as compared with an embodiment in which the holder 6 is provided on the lower surface of the bracket 2 and the holder 6 is in contact with the nut 14.

Furthermore, the length (first height h1) of the wall (protective member) 8 projecting from the upper surface of the bracket 2 to the side on which the ceiling frame 11 is located (upward in the z direction) is longer than the length between the surface of the holder 6 facing the ceiling frame 11 and the upper surface of the bracket 2 (height of the end 6*a* (second height h2)).

The holder 6 is positioned between the bracket 2 and the ceiling frame 11 in a state in which the holder 6 is not in contact with the ceiling frame 11, whereby it is possible to further decrease the possibility that the holder 6 is damaged when the fixing bolt 12 is tightened with the nut 14, as compared with an embodiment in which a protective member such as the wall 8 is not provided.

The beam 6*b* in the holder 6 is thinner than the end 6*a* and is held by the end 6*a* with the gap 6*c* provided between the beam 6*b* and the bracket 2. Furthermore, the beam 6*b* in the holder 6 has a portion forming the outer shape of the internal space 10, the portion having a sharp pointed tip. Therefore, the sharp pointed tip portion enters between the screw threads of the fixing bolt 12, making it possible for the holder 6 to easily hold the fixing bolt 12.

Furthermore, since the beam 6*b* is thinner than the end 6*a*, the beam 6*b* is more easily bent than the end 6*a*. Therefore, the fixing bolt 12 can be held in a state in which the fixing bolt 12 easily passes through the internal space 10 and is easily removed, and even after the temporary fixing is completed, the fixing bolt 12 can be easily removed for repair or the like.

In particular, in a case where the region in the holder 6 in contact with the fixing bolt 12 is made of resin, rubber, or the like, the fixing bolt 12 can be easily removed and is not easily damaged, as compared with a case where the region is made of metal.

Furthermore, the gap 6*c* is provided between the upper surface of the bracket 2 and the beam 6*b*, and the beam 6*b* is separated from the bracket 2. Therefore, when the fixing bolt 12 is inserted between the two beams 6*b*, the two beams 6*b* are easily bent in the direction away from each other. Furthermore, it is possible to prevent the two beams 6*b* from being drawn into the fixing bolt hole 4 of the bracket 2 by the insertion of the fixing bolt 12 and being pinched between the fixing bolt 12 and the fixing bolt hole 4. Furthermore, it also becomes possible to prevent the beam 6*b* from being firmly fixed to the bracket 2 or the like due to aged deterioration or the like.

Furthermore, the bracket 2 is arranged at a lower position by thicknesses of the holder 6 and the wall 8 (by a z-directional dimension). Thus, the antenna case 2*a* can be arranged at a low position.

If the antenna case 2*a* can be arranged low, in a case where the antenna element such as the patch antenna 9 is mounted on the antenna case 2*a* and the antenna mounting apparatus 1 is attached to the ceiling frame 11 of a windshield (or rear glass) of a vehicle, it becomes easy to avoid physical interference with a metal shield around the antenna element (especially in an upward direction).

Note that the holder 6 is not limited to a holder in which each of two beams 6*b* constitutes a both ends-fixed beam held by two ends 6*a* and the two ends 6*a* and the two beams 6*b* form a substantially hollow rectangular shape when in top view.

Figure 12:
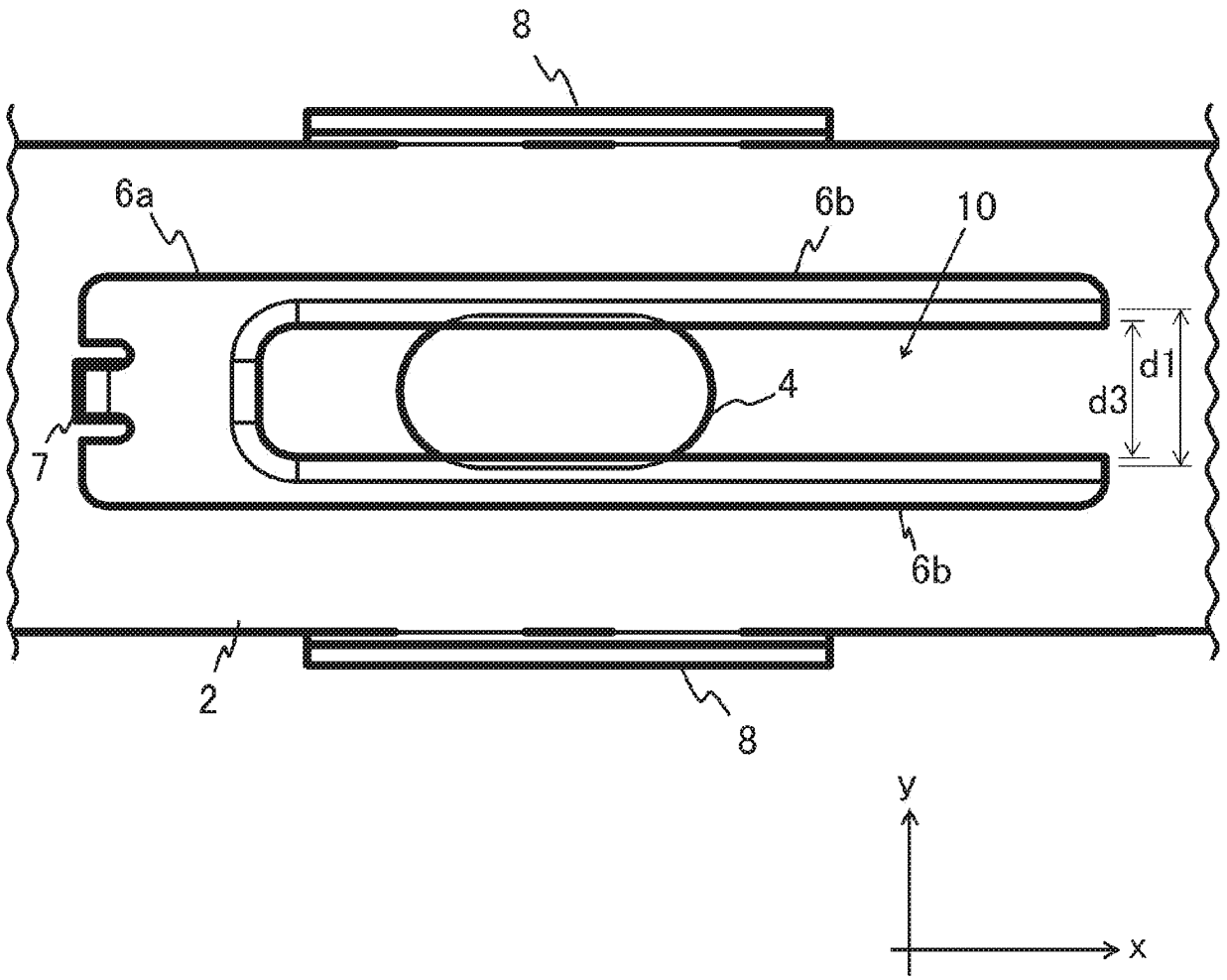
FIG. 12 is a top view illustrating a first modification of the holder.
Figure 13:
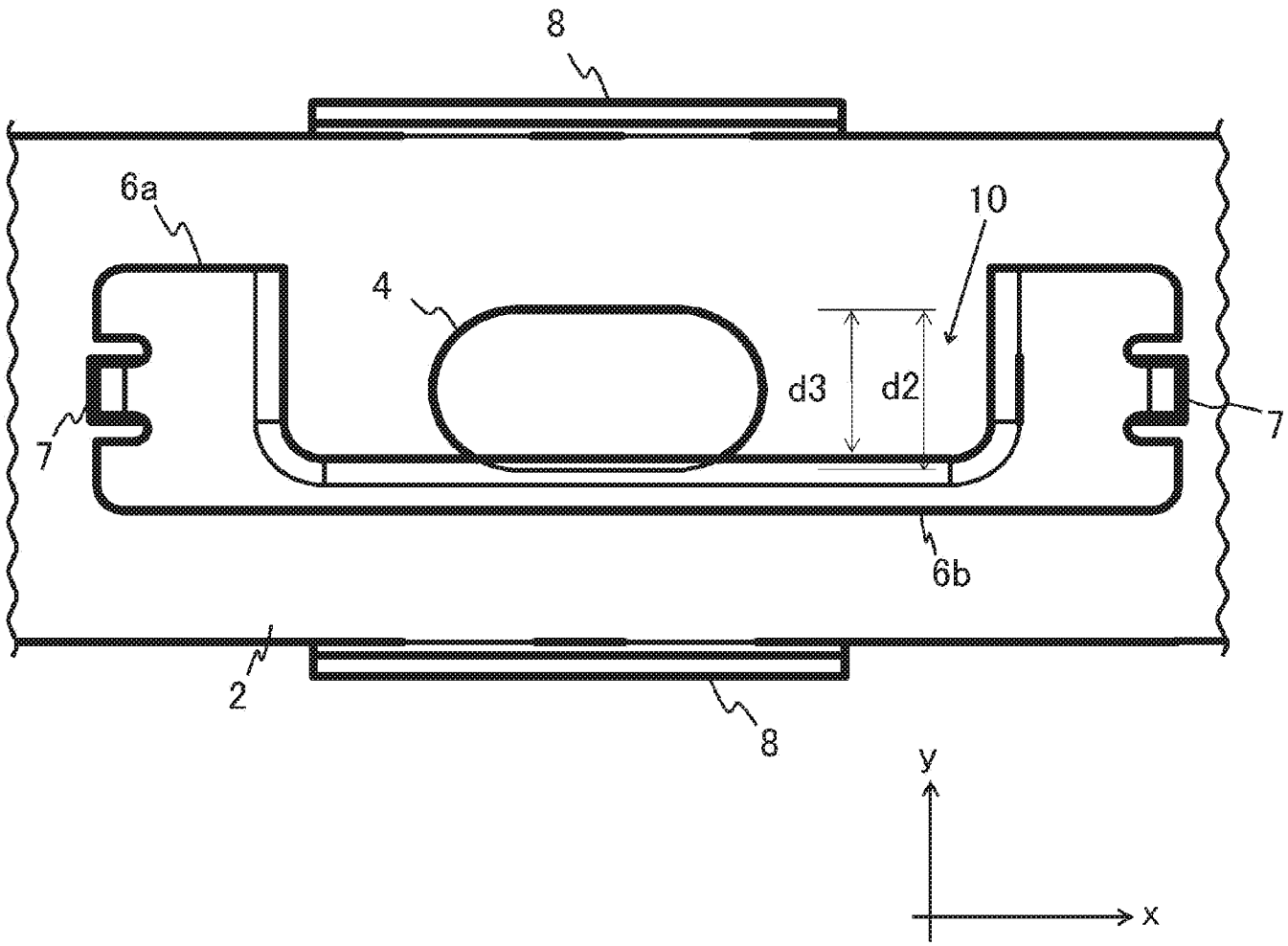
FIG. 13 is a top view illustrating a second modification of the holder.
Figure 14:
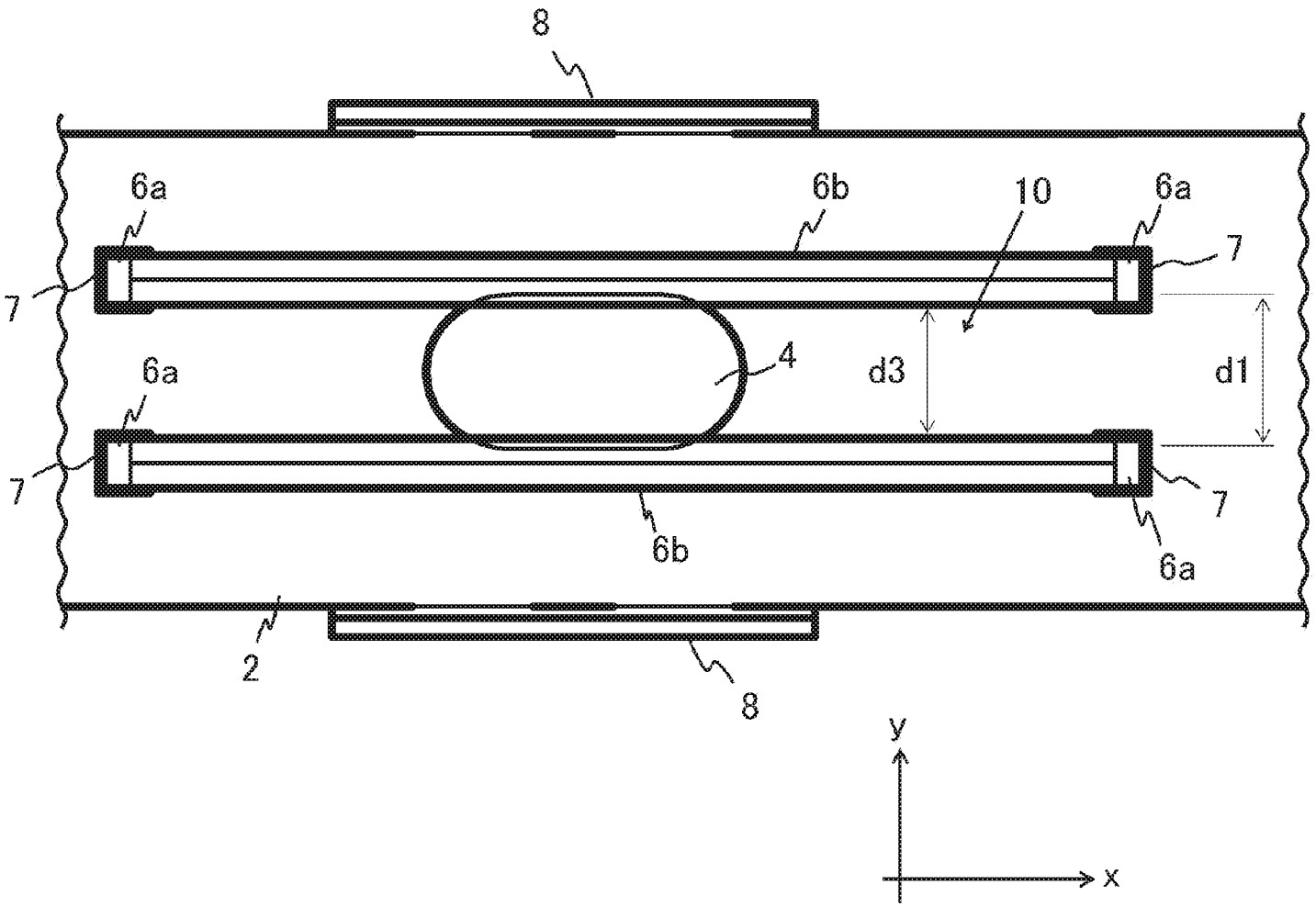
FIG. 14 is a top view illustrating a third modification of the holder.

For example, the holder 6 may be a first modification in which each of two beams 6*b* constitutes a cantilever beam held by one end 6*a*, and the one end 6*a* and the two beams 6*b* form a substantially U-shape in top view (see FIG. 12). Furthermore, the holder 6 may be a second modification in which one beam 6*b* constitutes a both ends-fixed beam held by two ends 6*a*, and the two ends 6*a* and the one beam 6*b* form a substantially U-shape in top view (see FIG. 13). Furthermore, the holder 6 may be a third modification in which one beam 6*b* constitutes a both ends-fixed beam held by two ends 6*a* and the two ends 6*a* and the one beam 6*b* form a substantially I-shape in top view, and two substantially I-shaped members in the top view are provided (see FIG. 14).

In the case of embodiments in which two beams 6*b* are provided (see FIGS. 12 and 14), the dimension of each part of the holder 6 and the positional relationship between the holder 6 and the bracket 2 are determined so that the two beams 6*b* engage with the fixing bolt 12 and the y-directional dimension d3 of the region overlapping the internal space 10 in the fixing bolt hole 4 when viewed from the z direction (y-directional interval between the two beams 6*b*) is shorter than the y-directional dimension d1 of the fixing bolt hole 4 and is substantially equal to or shorter than the nominal diameter d2 of the fixing bolt 12 ($d3 \leq d2 < d1$).

In the case of an embodiment in which one beam 6*b* is provided (see FIG. 13), the dimension of each part of the holder 6 and the positional relationship between the holder 6 and the bracket 2 are determined so that one beam 6*b* and the fixing bolt hole 4 engage with the fixing bolt 12 and the y-directional dimension d3 of the region in the fixing bolt hole 4 overlapping with the internal space 10 when viewed from the z direction is shorter than the y-directional dimension d1 of the fixing bolt hole 4 and is substantially equal to or shorter than the nominal diameter d2 of the fixing bolt 12 ($d3 \leq d2 < d1$).

That is, the dimension in the y direction (one direction perpendicular to the vertical direction) of the region in the fixing bolt hole 4 not overlapping the beam 6*b* when viewed from the z direction (vertical direction) is substantially equal to or shorter than the nominal diameter d2 of the fixing bolt hole 4.

Note that the fixing bolt hole 4 that includes a hole of a circular shape, substantially elliptical shape, or substantially rectangular shape may be a notch including a region of the circular shape, substantially elliptical shape, or substantially rectangular shape.

Even in this case, the dimension of each part of the holder 6 and the positional relationship between the holder 6 and the bracket 2 are determined so that the two beams 6*b* engage with the fixing bolt 12 and a y-directional dimension of a region in the notch overlapping the internal space 10 when viewed from the z direction is substantially equal to or shorter than the nominal diameter d2 of the fixing bolt 12. Alternatively, the dimension of each part of the holder 6 and the positional relationship between the holder 6 and the bracket 2 are determined so that one beam 6*b* and the notch engage with the fixing bolt 12 and the y-directional dimension of the region in the notch overlapping the internal space 10 when viewed from the z direction is substantially equal to or shorter than the nominal diameter d2 of the fixing bolt 12.

Figure 15:
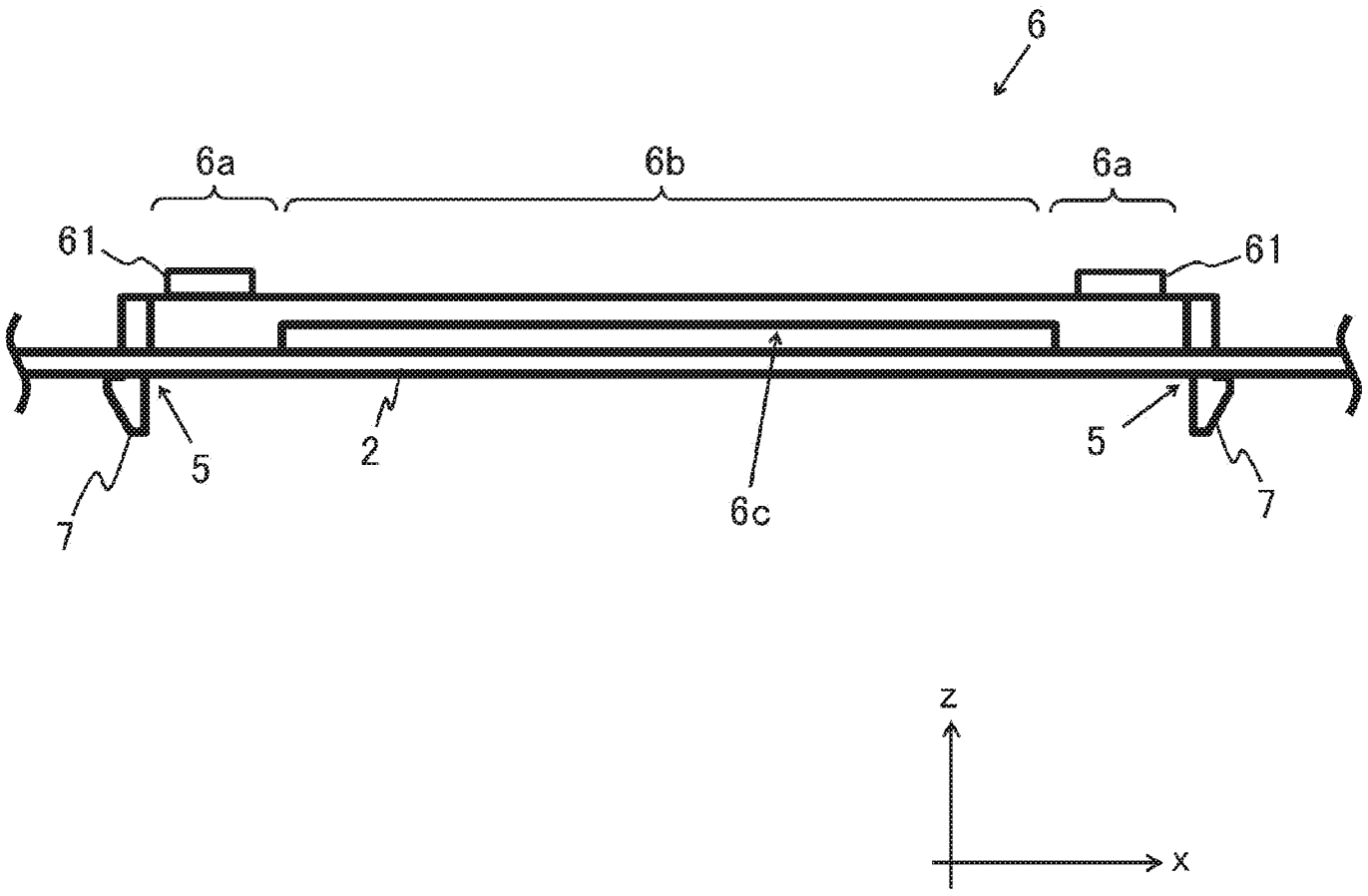
FIG. 15 is an enlarged side view of a region where a holder provided with a projecting region (spacer) is located.

Furthermore, in addition to or instead of the embodiments in which the protective member such as the wall 8 is provided on the bracket 2, a member (projecting member 61) projecting to a side on which the ceiling frame 11 is located from the upper surface of the beam 6*b* may be provided on at least one of the end 6*a* and the beam 6*b* in the holder 6. In this case, when the bracket 2 is screwed to the ceiling frame 11, the projecting member 61 may be used as a spacer that maintains a state in which a region in the holder 6 in contact with the fixing bolt 12 is separated from the ceiling frame 11 and the spacer may protect the region (see FIG. 15).

The projecting member 61 may be configured separately from the holder 6 or may be configured integrally with the holder 6.

REFERENCE SIGNS LIST

1 antenna mounting apparatus
2 bracket
2*a* antenna case
3 claw
4 fixing bolt hole
hook hole
6 holder (temporary fixing tool)
6*a* end
6*b* beam
6*c* gap
61 projecting member (spacer)
7 hook
8 wall (protective member)
9 patch antenna
internal space
11 ceiling frame
12 fixing bolt
13 claw hole
14 nut
d1 y-directional dimension of fixing bolt hole
d2 nominal diameter of fixing bolt
d3 y-directional dimension of region in fixing bolt hole overlapping internal space when viewed from z direction
d4 x-directional dimension of fixing bolt hole
h1 first height
h2 second height

The invention claimed is:

1. An antenna mounting apparatus for mounting at least a part of electronic components constituting an antenna device including an antenna element to a frame through a bolt fixed to the frame, comprising:

a bracket configured to hold at least the part of the electronic components and be fixed by the bolt; and a holder provided on a first surface of the bracket facing the frame, wherein the holder is configured to temporarily engage the bolt when the bolt is inserted through the bracket, wherein the bracket is provided with a protective member that protects the holder, and wherein a length of the protective member projecting from the first surface to a side on which the frame is located is longer than a length between a surface of the holder facing the frame and the first surface.

2. The antenna mounting apparatus according to claim 1, wherein at least a region in the holder, configured to contact the bolt when inserted, is made of resin or rubber.

3. The antenna mounting apparatus according to claim 1, wherein at least one of the bracket and the holder is provided with a spacer that maintains a state in which at least a region in the holder in contact with the bolt is separated from the frame.

4. The antenna mounting apparatus according to claim 1, wherein the bracket is provided with a bolt hole through which the bolt passes when inserted, and when viewed from a vertical direction in which the bracket and the holder are arranged, a dimension of a region in the bolt hole not overlapping a member constituting the holder in one direction perpendicular to the vertical direction is equal to or shorter than a nominal diameter of the bolt.

5. The antenna mounting apparatus according to claim 1, wherein the bracket is provided with a bolt hole through which the bolt passes when inserted, the holder is provided with a beam, a gap is provided between the beam and the bracket, and When viewed from a vertical direction in which the bracket and the holder are arranged, a dimension of a region in the bolt hole not overlapping the beam in one direction perpendicular to the vertical direction is equal to or shorter than a nominal diameter of the bolt.

6. The antenna mounting apparatus according to claim 1, further comprising:

a nut configured to screw the bolt, wherein the nut is screwed to the bolt after the holder was temporarily engage the bolt.

* * * * *